US005106256A

United States Patent [19]

Murakami et al.

[11] Patent Number: 5,106,256

[45] Date of Patent: Apr. 21, 1992

[54] STEP DEVICE IN MINIATURE SHOVEL CAR

[75] Inventors: Yoshiaki Murakami; Takahisa Murakami; Seiji Nishihara, all of Yakura; Hidetomo Kasa, Hiroshima, all of Japan

[73] Assignee: Kabushiki Kaisha Kobe Seiko Sho, Kobe, Japan

[21] Appl. No.: 548,861

[22] Filed: Jul. 6, 1990

[30] Foreign Application Priority Data

Aug. 7, 1989 [JP] Japan ..... 1-204168
Aug. 7, 1989 [JP] Japan ..... 1-204169

[51] Int. Cl.[5] ..... B60P 3/00

[52] U.S. Cl. ..... 414/687; 172/434; 180/89.13; 280/166

[58] Field of Search ..... 414/687, 685, 686, 703; 280/166, 764.1, 163, 164.1, 165; 180/324, 89.13; 172/434, 433, 431

[56] References Cited

U.S. PATENT DOCUMENTS

| | | | |
|---|---|---|---|
| 2,794,382 | 6/1957 | Ellson | 414/685 X |
| 2,926,796 | 3/1960 | Martinson | 414/687 X |
| 3,002,638 | 10/1961 | Needy | 414/687 |
| 3,226,857 | 1/1966 | Porter et al. | 414/685 X |
| 3,393,759 | 7/1968 | Gustavsson . | |
| 3,630,544 | 12/1971 | Grisham | 280/764.1 |
| 3,869,022 | 3/1975 | Wallk | 280/166 X |
| 4,077,141 | 3/1978 | Stedman | 414/685 X |
| 4,236,643 | 12/1980 | Schmitz | 280/764.1 X |
| 4,360,311 | 11/1982 | Dufour | 414/687 |
| 4,626,163 | 12/1986 | Link et al. | 280/166 X |
| 4,961,371 | 10/1990 | Takashima | 414/687 X |

FOREIGN PATENT DOCUMENTS

| | | | |
|---|---|---|---|
| 76876 | 12/1953 | Denmark | 414/703 |
| 0156034 | 10/1985 | European Pat. Off. | 172/431 |
| 0189008 | 7/1986 | European Pat. Off. . | |
| 1002204 | 7/1957 | Fed. Rep. of Germany . | |
| 1054381 | 4/1959 | Fed. Rep. of Germany | 414/687 |
| 409076 | 1/1945 | Italy | 414/687 |
| 8402153 | 6/1984 | PCT Int'l Appl. . | |
| 631638 | 11/1949 | United Kingdom | 180/324 |

*Primary Examiner*—Robert J. Spar
*Assistant Examiner*—William M. Hienz
*Attorney, Agent, or Firm*—Oblon, Spivak, McClelland, Maier & Neustadt

[57] ABSTRACT

A step device in a miniature shovel car includes a vehicle body, a working boom mounted to a front portion of the vehicle body, a boom cylinder for vertically pivotably operating the boom, a swing cylinder for horizontally pivotably operating the boom, and an engine and a transmission case both mounted on a rear portion of the vehicle body. The step device includes a recess formed at a laterally central portion of a lower surface of the transmission case and extending in a longitudinal direction of the transmission case, a step arm pivotably mounted at its front end to a front portion of the recess, and a step mounted to a rear end of the step arm. The step arm is adapted to be raised and lowered, and the step arm is retracted into the recess when raised.

4 Claims, 11 Drawing Sheets

STEP DEVICE IN MINIATURE SHOVEL CAR

BACKGROUND OF THE INVENTION

The present invention relates to a step device in a miniature shovel car.

A miniature shovel car capable of carrying out an excavating operation in a narrow area has not conventionally existed. In order to manufacture such a miniature shovel car, it is considered that an operator seat is not provided in order to make a vehicle body compact, and that an operator stands on the ground behind the vehicle body to operate a working boom and bucket for the excavating operation, or he stands on a step provided at a rear portion of the vehicle body to carry out the excavating operation or travel the vehicle body forwardly and reversely.

In such a miniature shovel car having the step provided at the rear portion of the vehicle body, the excavating and driving operation is normally carried out under the condition where the operator stands on the step. However, in the case where the above operation is carried out under the condition where the operator stands on the ground behind the vehicle body, the step should be lifted so as not to hinder the operation. In this case, it is required to lift the step and a step arm for supporting the step as highly as possible and thereby ensure a sufficient ground clearance of the step and the step arm.

Further, as the step is provided by at the rear portion of the vehicle body, a leveling operation behind the vehicle body is difficult to carry out. That is, in carrying out the leveling operation behind the vehicle body, it is necessary to turn the vehicle body by 180 degrees, thus rendering the leveling operation troublesome.

Further, as the vehicle body is compact to produce a reduction in weight, an excavating force of the bucket is reduced.

SUMMARY OF THE INVENTION

It is an object of the present invention to increase a lifting stroke of the step and the step arm and efficiently carry out a leveling operation behind the vehicle body.

It is another object of the present invention to increase an excavating force in spite of a compact vehicle body and improve a working ability.

According to one aspect of the present invention, there is provided in a miniature shovel car including a vehicle body, a working boom mounted to a front portion of said vehicle body, a boom cylinder for vertically pivotably operating said boom, a swing cylinder for horizontally pivotably operating said boom, and an engine and a transmission case both mounted on a rear portion of said vehicle body; a step device comprising a recess formed at a laterally central portion of a lower surface of said transmission case and extending in a longitudinal direction of said transmission case, a step arm pivotably mounted at its front end to a front portion of said recess, and a step mounted to a rear end of said step arm, said step arm being adapted to be raised and lowered, said step arm being retracted into said recess when raised.

In the above aspect of the present invention, the step device preferably further comprises a leveling blade detachably mounted to a rear end of said step.

As mentioned above, the transmission case is mounted on the rear portion of the vehicle body, and the recess is formed at the laterally central portion of the lower surface of the transmission case in such a manner as to extend in the longitudinal direction of the transmission case. Further, the step arm is vertically movably mounted at the rear portion of the vehicle body, and the front end of the step arm is pivotably supported at the front portion of the recess. With this construction, when the step arm is pivoted upwardly, it can be retracted into the recess. Accordingly, when the step is not used, the step arm can be raised as highly as possible to thereby ensure a sufficient ground clearance of the step arm.

Further, the leveling blade is preferably mounted to the rear end of the step. In this case, when the step arm is lowered, the leveling blade is brought into contact with the ground. When the vehicle body is traveled forwardly or reversely under this condition, a leveling operation can be carried out by the leveling blade. Moreover, as the leveling blade is detachable, it can be easily removed from the step when not used.

According to another aspect of the present invention, there is provided in a miniature shovel car including a vehicle body, a working boom mounted to a front portion of said vehicle body, a boom cylinder for vertically pivotably operating said boom, a swing cylinder for horizontally pivotably operating said boom, and an engine and a transmission case both mounted on a rear portion of said vehicle body; a step mounting device comprising a pair of right and left driving shafts projecting laterally from opposite sides of said transmission case, a pair of right and left driving wheels mounted on said right and left driving shafts, respectively, a step arm having a front end pivotably supported at a position before said driving shafts, and a step foldably connected to a rear end of said step arm.

As mentioned above, the front end of the step arm is pivotably mounted at a position in front of the driving shafts projecting laterally from the opposite sides of the transmission case. The step is mounted to the rear end of the step arm. When an operator stands on the step to carry out various operations, a weight of the operator is loaded on the step. This load is applied to the mounting portion of the step arm. Since the mounting portion is located at the position in front of the driving shafts, a ground load of the vehicle body as a whole is concentrated at the substantially central portion of the vehicle body, and the weight of the operator is added to the ground load. Accordingly, an increased load greater than a weight of the vehicle body can be applied as an excavating force, thereby exhibiting a sufficient excavating performance in spite of a compact vehicle body.

Other objects and features of the invention will be more fully understood from the following detailed description and appended claims when taken with the accompanying drawings.

DETAILED DESCRIPTION OF THE PREFERRED EMBODIMENTS

Figure 1:
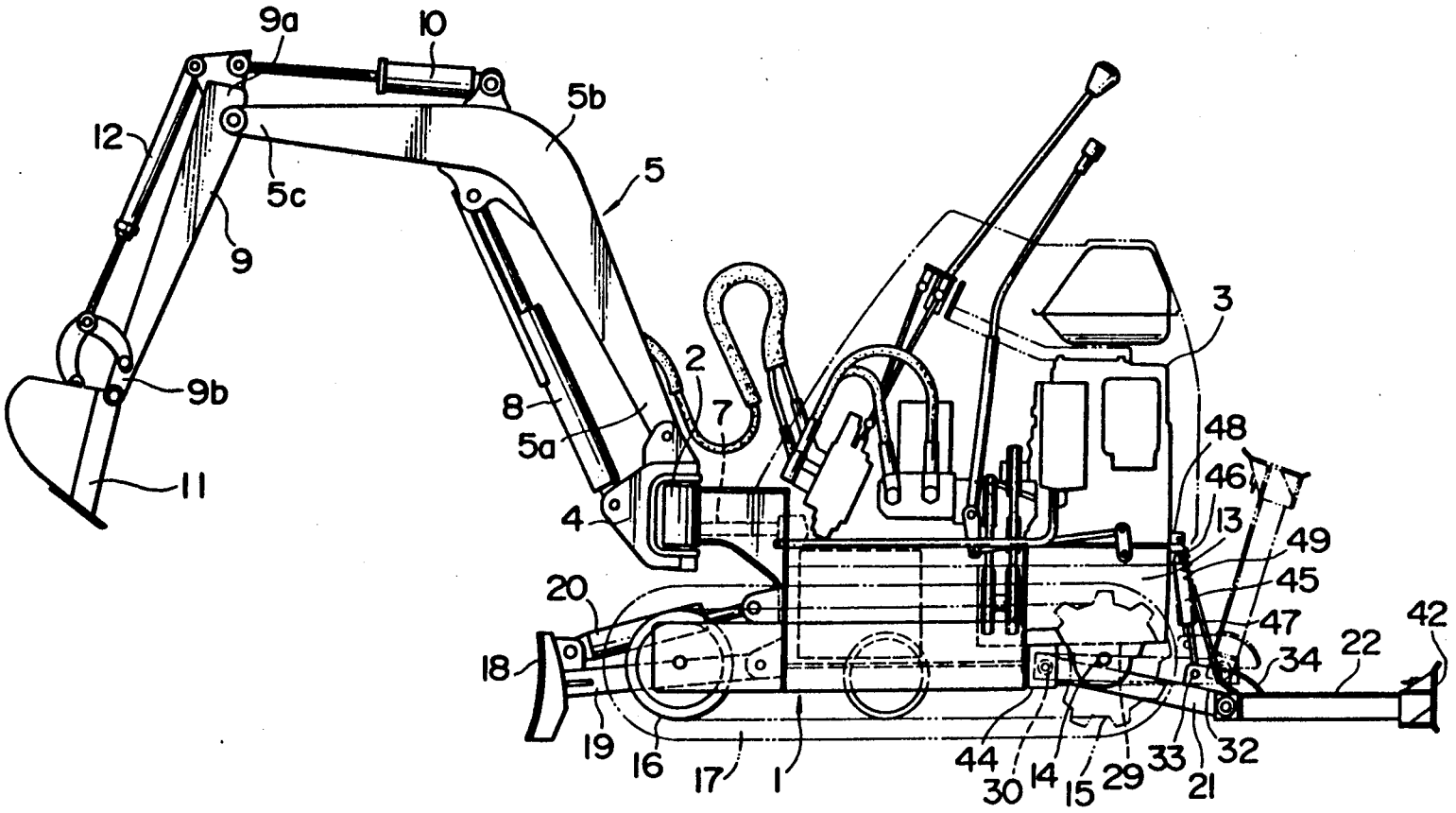
FIG. 1 is a partially cut-away side view of the miniature shovel car according to a first preferred embodiment of the present invention.
Figure 2:
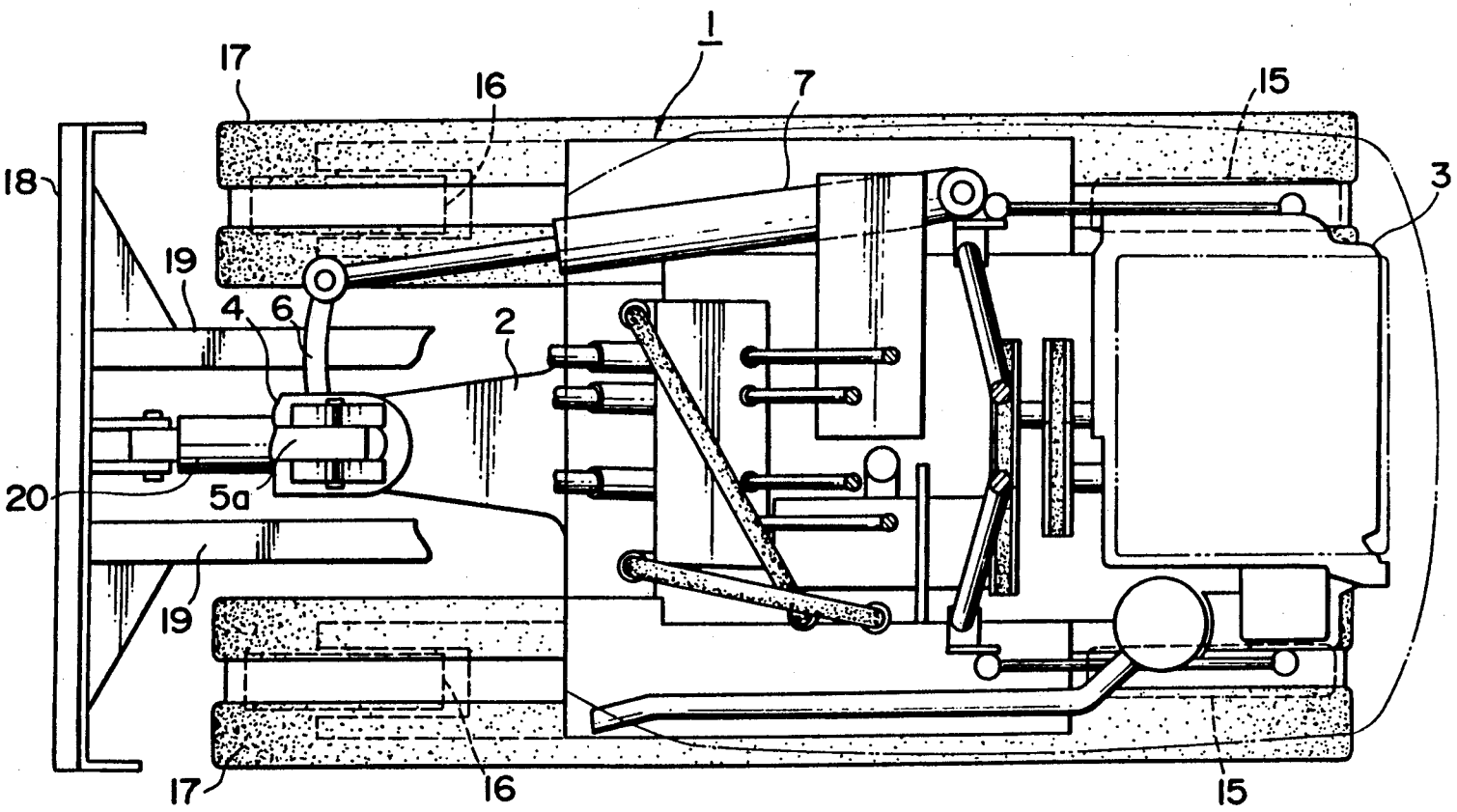
FIG. 2 is a plan view of a frame and its associated parts shown in FIG. 1.
Figure 3:
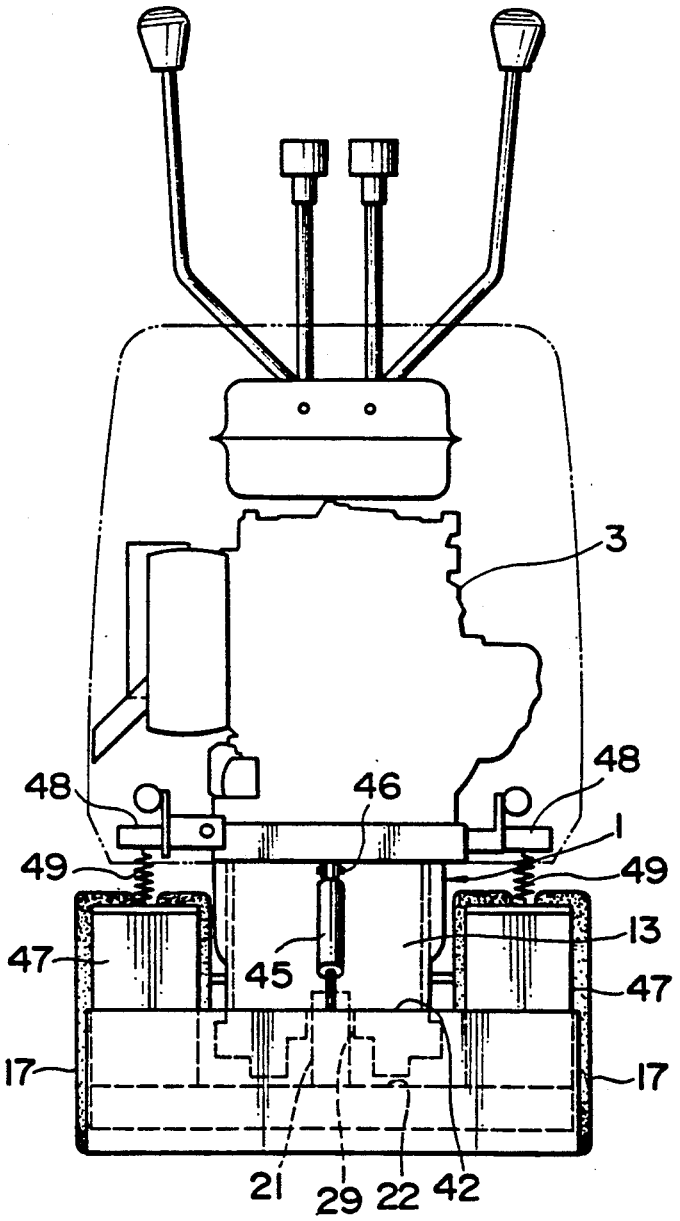
FIG. 3 is a rear elevational view of FIG. 1.

There will now be described some preferred embodiments of the present invention with reference to the accompanying drawings. Referring to FIGS. 1 to 3 which show a first preferred embodiment of the miniature shovel car according to the present invention, a frame 1 is provided at its front end with a mounting portion 2 for mounting a working boom 5. An engine 3 is mounted on a rear portion of the frame 1. A swing bracket 4 is horizontally pivotably mounted to the mounting portion 2. A base end 5*a* of the boom 5 is vertically pivotably connected to the swing bracket 4. An arm bracket 6 projects horizontally from one side of the swing bracket 4. A swing cylinder 7 is provided at one side portion of the frame 1, and a front end of the swing cylinder 7 is pivotably connected to a free end of the arm bracket 6, so that the boom 5 can be horizontally swiveled by operating the swing cylinder 7. A boom cylinder 8 is connected between the swing bracket 4 and a middle portion 5*b* of the boom 5, so that the boom 5 can be vertically pivoted at the base end 5*a* by operating the boom cylinder 8. An arm 9 is pivotably connected at its base end 9*a* to a forward end 5*c* of the boom 5. An arm cylinder 10 is connected between the middle portion 5*b* of the boom and the base end 9*a* of the arm 9, so that the arm 9 can be vertically pivoted at the base end 9*a* by operating the arm cylinder 10. Further, a bucket 11 is pivotably connected to a forward end 9*b* of the arm 9, and it can be vertically pivoted by operating a bucket cylinder 12.

A transmission case 13 is fixedly mounted under the engine 3, and a pair of right and left driving shafts 14 project laterally in opposite directions from the transmission case 13. A pair of right and left driving sprockets 15 are mounted on the right and left driving shafts 14 at the projecting ends thereof, respectively. A pair of right and left driven sprockets 16 are rotatably supported to a front lower portion of the frame 1. A pair of right and left crawlers 17 are wrapped around the right driving and driven sprockets 15 and 16 and the left driving and driven sprockets 15 and 16, respectively. A pair of arms 19 of a front leveling blade 18 are vertically pivotably supported at their rear ends to the front end of the frame 1 between the driven sprockets 16, so that the front leveling blade 18 can be vertically pivoted by operating a hydraulic cylinder 20. Further, a step arm 21 is provided under the transmission case 13 and extends rearwardly. A step 22 is pivotably connected to a rear end of the step arm 21.

Figure 4:
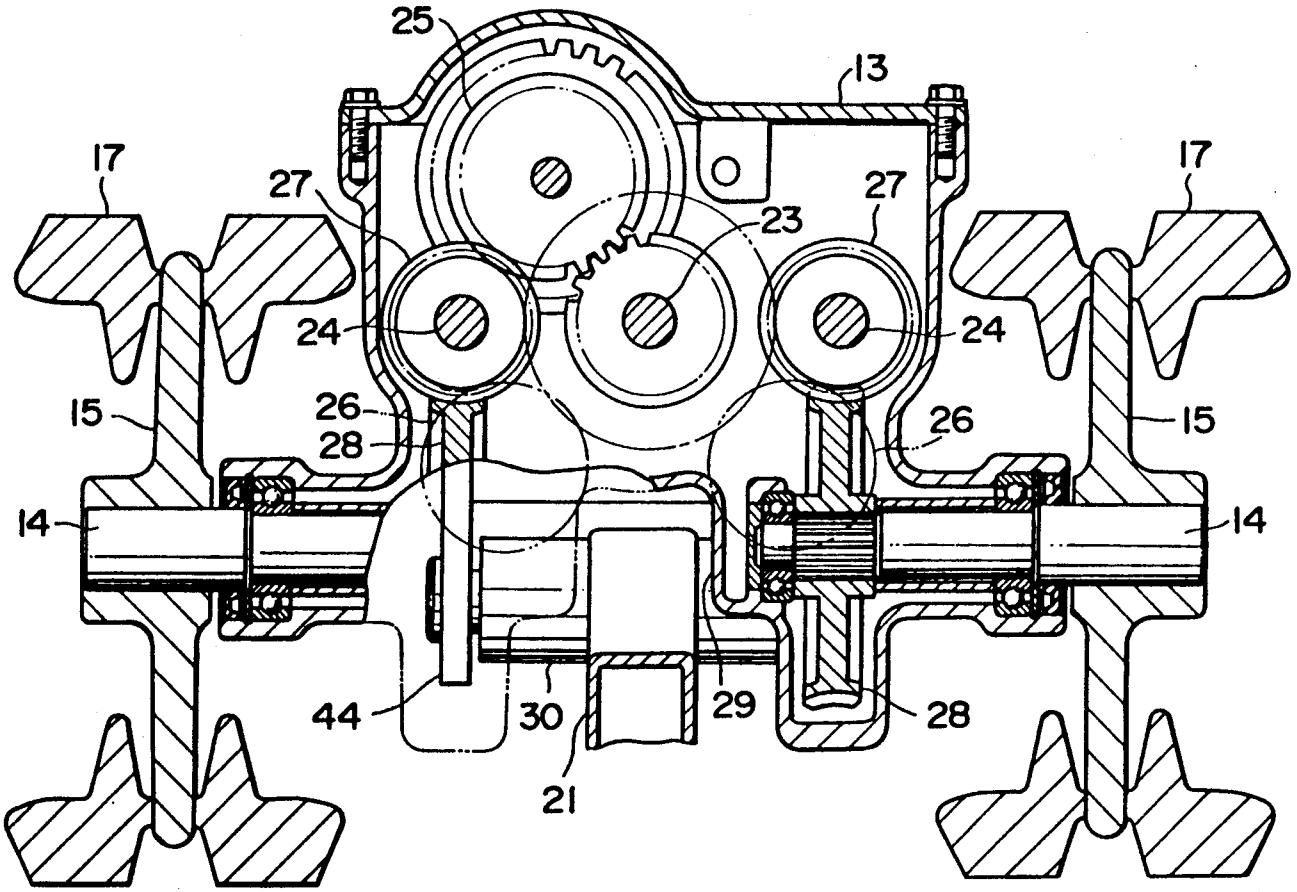
FIG. 4 is a partially cut-away vertical sectional view in rear elevation of a transmission case.

Referring to FIG. 4, an input shaft 23 is rotatably provided at a central portion in the transmission case 13 and extends in a longitudinal direction of the transmission case 13. A pair of intermediate shafts 24 parallel to the input shaft 23 are rotatably provided on the right and left sides of the input shaft 23. A rotational speed of the input shaft 23 is once changed by an auxiliary speed change gear 25, and thereafter the rotation is transmitted from the input shaft 23 directly to or through a pair of counter gears 26 to the intermediate shafts 24. A pair of right and left worms 27 are mounted on end portions of the right and left intermediate shafts 24, respectively, and a pair of right and left worm wheels 28 are mounted on inner end portions of the right and left driving shafts 14, respectively. The right and left worms 27 mesh the right and left worm wheels 28, respectively, to transmit the rotation of the right and left intermediate shafts 24 to the right and left driving shafts 14. Thus, an engine power is transmitted through the worms 27 and the worm wheels 28 in combination. Accordingly, there is defined a space between the right and left worm wheels 28, thereby forming a recess 29 at a laterally central portion of a lower surface of the transmission case 13 in such a manner as to extend in the longitudinal direction of the transmission case 13.

Figure 5:
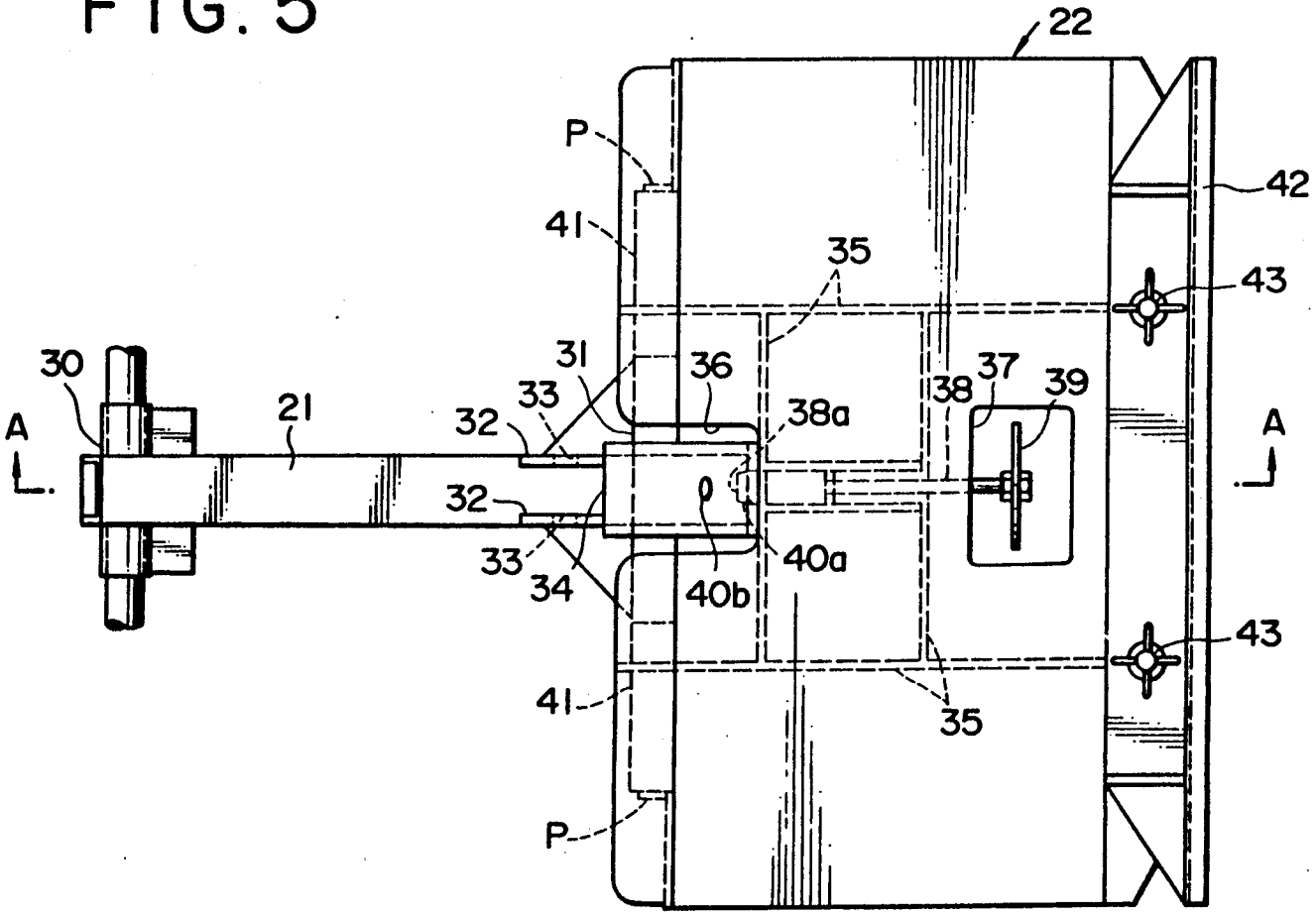
FIG. 5 is a plan view of an essential part of the step device.
Figure 6:
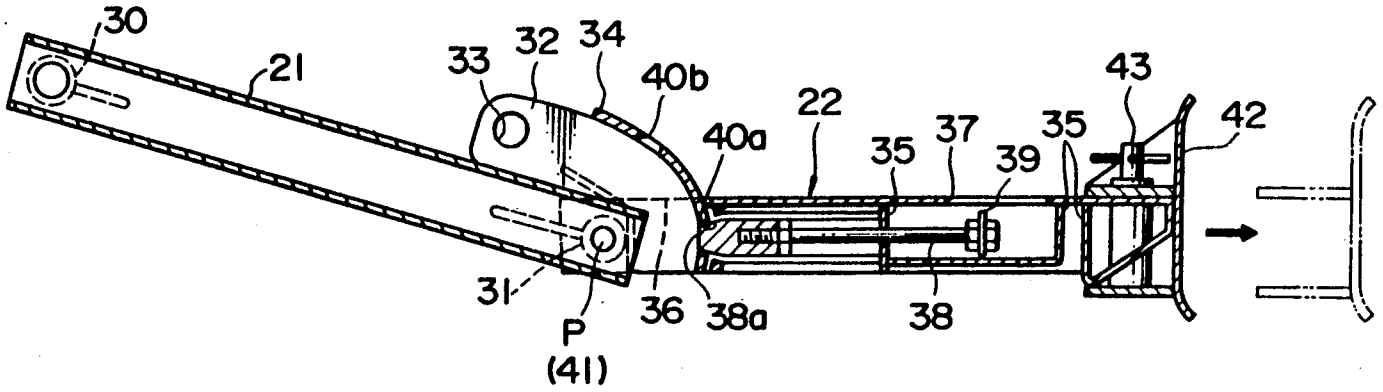
FIG. 6 is a cross section taken along the line A—A in FIG. 5.

The construction of the step arm 21 and the step 22 will now be described with reference to FIGS. 5 and 6. The step arm 21 is formed at its front and rear ends with bearing portions 30 and 31. A pair of parallel support plates 32 are provided to project upwardly from an upper surface of the rear end portion of the step arm 21. The support plates 32 are formed at their front end portion with coaxial holes 33. A curved guide plate 34 is fixed to upper surfaces of rear portions of the support plates 32.

A plurality of reinforcing plates 35 are fixed to a lower surface of the step 22 at suitable positions. The step 22 is formed at its front central portion with a recess 36, and is also formed at its rear central portion with an opening 37. A stopper rod 38 is provided in a central portion of the step 22 so as to be slidable forwardly and reversely. A handle 39 is formed at a rear end of the stopper rod 38, and it is so located as to be exposed through the opening 37 to the outside. The guide plate 34 is formed with two stopper holes 40*a* and 40*b* to be selectively engaged with a front end 38*a* of the stopper rod 38. Accordingly, when the handle 39 is gripped by an operator, and is moved forwardly or reversely, the front end 38*a* of the stopper rod 38 can be engaged with or disengaged from the stopper hole 40*a* or 40*b*. Further, the step 22 is formed at its front end with a pair of right and left bearing portions 41 engaging opposite ends of the rear bearing portion 31 of the step arm 21. A pivot pin P is inserted into the bearing portions 41 of the step 22 and the rear bearing portion 31 of the step arm 21.

Thus, the step 22 is vertically pivotably connected to the rear bearing portion 31 of the step arm 21. Further, the step 22 is locked to the step arm 21 by engaging the front end 38*a* of the stopper rod 38 with the stopper hole 40*a* or 40*b* of the guide plate 34. Further, a rear leveling blade 42 may be mounted to a rear end of the step 22. The rear leveling blade 42 is detachably mounted to the step 22 by means of a pair of lock pins 43, so that the rear leveling blade 42 can be removed when it is not used.

As shown ib FIG. 1 to 4, a bracket is fixed to the lower surface of the transmission case 3 at a front position of the recess 29, and the front bearing portion 30 of the step arm 21 is pivotably mounted to the bracket 44. A hydraulic cylinder 45 is pivotably connected at its lower end to the coaxial holes 33 of the support plates 32. A bracket 46 projects rearwardly from the lower rear end of the transmission case 13, and an upper end of the hydraulic cylinder 45 is pivotably connected to the bracket 46. Accordingly, when the hydraulic cylinder 45 is operated to expand, the step arm 21 is pivoted downwardly to lower the step 22, while when the hydraulic cylinder 45 is operated to contract, the step arm 21 is pivoted upwardly to raise the step 22. In the case where the rear leveling blade 42 is mounted to the rear end of the step 22, a leveling operation can be carried out by lowering the step 22 until the rear leveling blade 42 comes into contact with the ground and moving a vehicle body forwardly or reversely under the contact condition of the rear leveling blade 42. Under the raised condition of the step 22, the step arm 21 is retracted in the recess 29 of the transmission case 13, thereby ensuring a sufficient ground clearance of the step arm 21. Furthermore, the operator can operate on the step 22. On the other hand, as the step 22 can be folded so as to be swung upwardly and be locked under the folded condition, there is no possibility that the working to be carried out behind the vehicle body will be hindered by the step 22.

Further, a pair of right and left protective covers 47 are mounted at their lower ends to the front end portions of the step 22 behind the right and left crawlers 17. Upper ends of the protective covers 47 are connected through tension springs 49 to a pair of mounting members 48 fixed to the transmission case 13. Owing to the protective covers 47, it is possible to prevent pebbles and sand thrown up by the crawlers 17 from being scattered rearwardly, thereby improving the safety for the operator. Moreover, as the protective covers 47 are normally biased upwardly by a tensile force of the springs 49, the scattering of the pebbles or the like can be protected irrespective of the vertical movement of the step 22, and there is no fear that the protective covers 47 will be drawn into spaces between the crawlers 17 and the vehicle body. The protective covers 47 may be formed of an elastic material such as rubber. In this case, the protective covers 47 are normally stretched by the tensile force of the springs 49, and there is no possibility of the protective covers 47 being slackened.

According to the first preferred embodiment of the present invention as mentioned above, the step arm can be retracted into the recess formed on the lower surface of the transmission case, thereby ensuring a sufficient ground clearance under the raised condition of the step. Accordingly, even in carrying out work on a greatly uneven rough road, it is possible to reduce a danger that a lower portion of the vehicle body will collide with an obstacle. Furthermore, the mechanical strength of the transmission case can be increased by the formation of the recess, thereby providing a shovel car having a compact and strong vehicle body construction. Additionally, in the case that the rear leveling blade is mounted to the rear end of the step, a leveling operation can be carried out behind the vehicle body. As the rear leveling blade is detachable, it can be easily removed from the step when not used.

Referring next to FIGS. 7 to 11 which show a second preferred embodiment of the miniature shovel car according to the present invention, a frame 101 is provided at its front end with a mounting portion 102 for mounting a working boom 105. An engine 103 is mounted on a rear portion of the frame 101. A swing bracket 104 is horizontally pivotably mounted to the mounting portion 102. A base end **105*a* of the boom 105 is vertically pivotably connected to the swing bracket 104. An arm bracket 106 projects horizontally from one side of the swing bracket 104. A swing cylinder 107 is provided at one side portion of the frame 101, and a front end of the swing cylinder 107 is pivotably connected to a free end of the arm bracket 106, so that the boom 105 can be horizontally swiveled by operating the swing cylinder 107. A boom cylinder 108 is connected between the swing bracket 104 and a middle portion 105*b* of the boom 105, so that the boom 105 can be vertically pivoted at the base end 105*a* by operating the boom cylinder 108. An arm 109 is pivotably connected at its base end 109*a* to a forward end 105*c* of the boom 105. An arm cylinder 110 is connected between the middle portion 105*b* of the boom 105 and the base end 109*a* of the arm 109, so that the arm 109 can be vertically pivoted at the base end 109*a* by operating the arm cylinder 110. Further, a bucket 111 is pivotably connected to a forward end 109*b* of the arm 109, and it can be vertically pivoted by operating a bucket cylinder 112**.

A transmission case 113 is fixedly mounted under the engine 103, and a pair of right and left driving shafts 114 project laterally in opposite directions from the transmission case 113. A pair of right and left driving sprockets 115 are mounted on the right and left driving shafts 114 at the projecting ends thereof, respectively. A pair of right and left driven sprockets 116 are rotatably supported to a front lower portion of the frame 101. A pair of right and left crawlers 117 are wrapped around the right driving and driven sprockets 115 and 116 and the left driving and driven sprockets 115 and 116, respectively. A pair of arms 119 of a front leveling blade 118 are vertically pivotably supported at their rear ends to the front end of the frame 101 between the driven sprockets 116, so that the front leveling blade 118 can be vertically pivoted by operating a hydraulic cylinder 120. Further, a bracket 121 is formed to project downwardly from a front lower surface of the transmission case 113 at a substantially laterally central position thereof, and a step arm 122 is vertically pivotably mounted at its front end to the bracket 121. A step 123 is foldably mounted to a rear end of the step arm 122. A hydraulic cylinder 124 is connected at its lower end to the step arm 122, so that the step arm 122 can be pivoted to raise and lower the step 123 by operating the hydraulic cylinder 124.

A supporting member 125 is fixed at its lower end to a rear surface of the transmision case 113, and is fixed at its upper end to a bracket 126 provided at an upper rear portion of the engine 103. Further, a mounting member 128 for mounting a seat 127 is obliquely fixed to the supporting member 125.

The construction of the step arm 122 and the step 123 will now be described with reference to FIGS. 8 and 9. The step arm 122 is formed at its front and rear ends with bearing portions 129 and 130. A pair of parallel support plates 131 are provided to project upwardly from an upper surface of the rear end portion of the step arm 122. The support plates 131 are formed at their front end portion with coaxial holes 132. A curved guide plate 133 is fixed to upper surfaces of rear portions of the support plates 131.

A plurality of reinforcing plates 134 are fixed to a lower surface of the step 123 at suitable positions. The step 123 is formed at its front central portion with a recess 135, and is also formed at its rear central portion with an opening 136. A stopper rod 137 is provided in a central portion of the step 123 so as to be slidable forwardly and reversely. A handle 138 is formed at a rear end of the stopper rod 137, and it is so located as to be exposed through the opening 136 to the outside. The guide plate 133 is formed with two stopper holes 139*a* and 139*b* to be selectively engaged with a front end 137*a* of the stopper rod 137. Accordingly, when the handle 138 is gripped by an operator, and is moved forwardly or reversely, the front end 137*a* of the stopper rod 137 can be engaged with or disengaged from the stopper hole 139*a* or 139*b*. Further, the step 123 is formed at its front end with a pair of right and left bearing portions 140 engaging opposite ends of the rear bearing portion 130 of the step arm 122. A pivot pin 141 is inserted into the bearing portions 140 of the step 123 and the rear bearing portion 130 of the step arm 122.

Thus, the step 123 is vertically pivotably connected to the rear bearing portion 130 of the step arm 122. Further, the step 123 is locked to the step arm 122 by engaging the front end 137*a* of the stopper rod 137 with the stopper hole 139*a* or 139*b* of the guide plate 133. That is, when the step 123 is not used, it can be folded so as to be swung upwardly as shown by a phantom line in FIG. 9.

Figure 8:
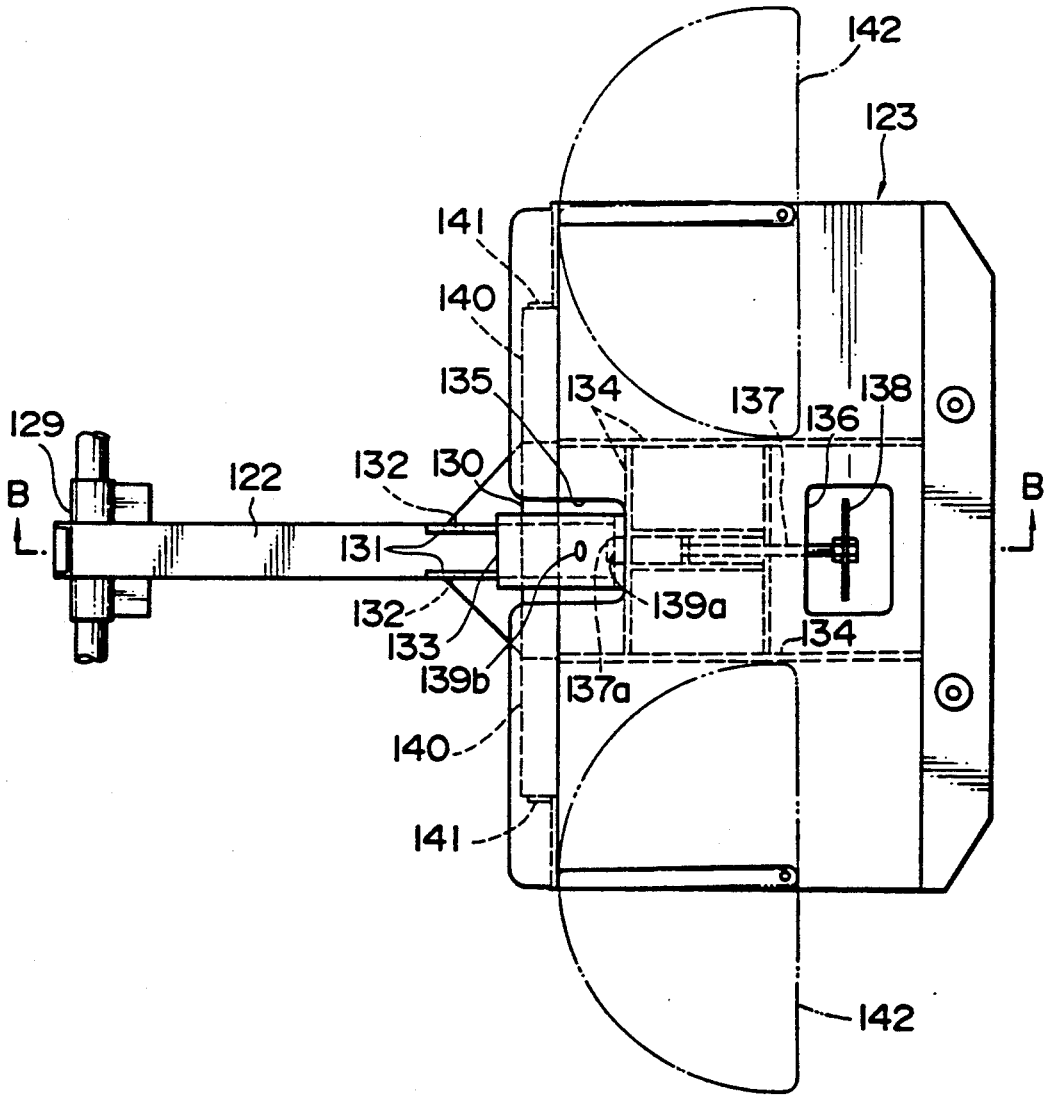
FIG. 8 is a plan view of an essential part of the step mounting device.
Figure 9:
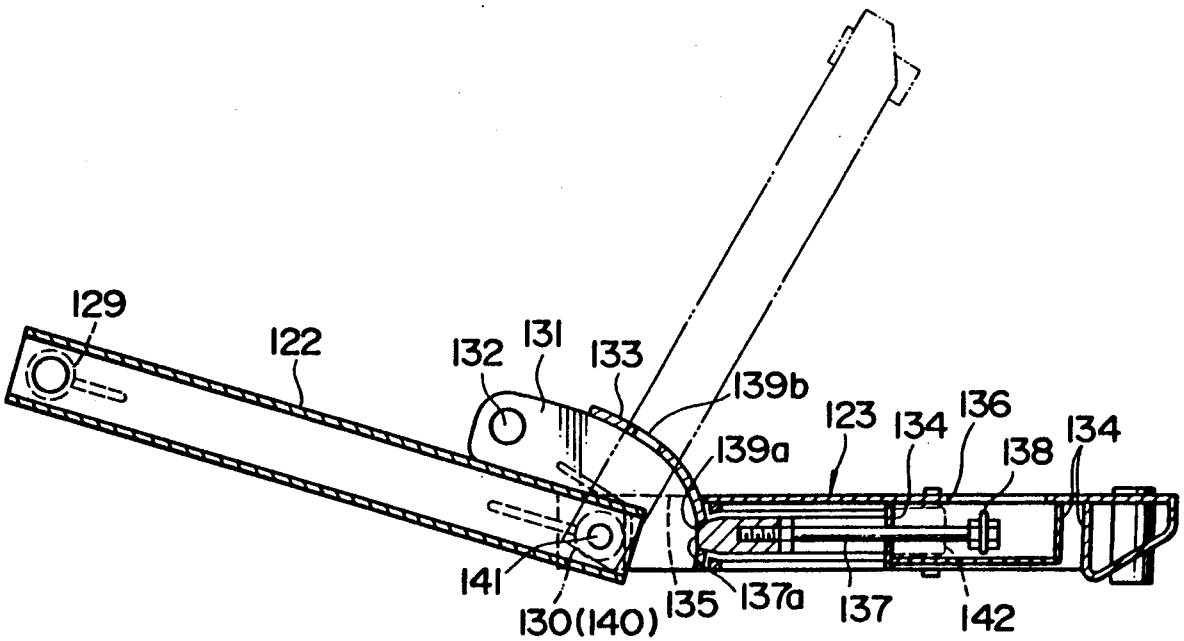
FIG. 9 is a cross section taken along the line B—B in FIG. 8.

Futher, as shown in FIG. 8, a pair of sectoral sub steps 142 may be horizontally pivotably mounted at the right and left side portions of the step 123 in such a manner as to be retractable from the side portions into the step 123. Accordingly, when the sub steps 142 are drawn out of the step 123, a width of the step as a whole can be increased, thereby contibuting to a stability of an operator in working on the step.

Figure 10:
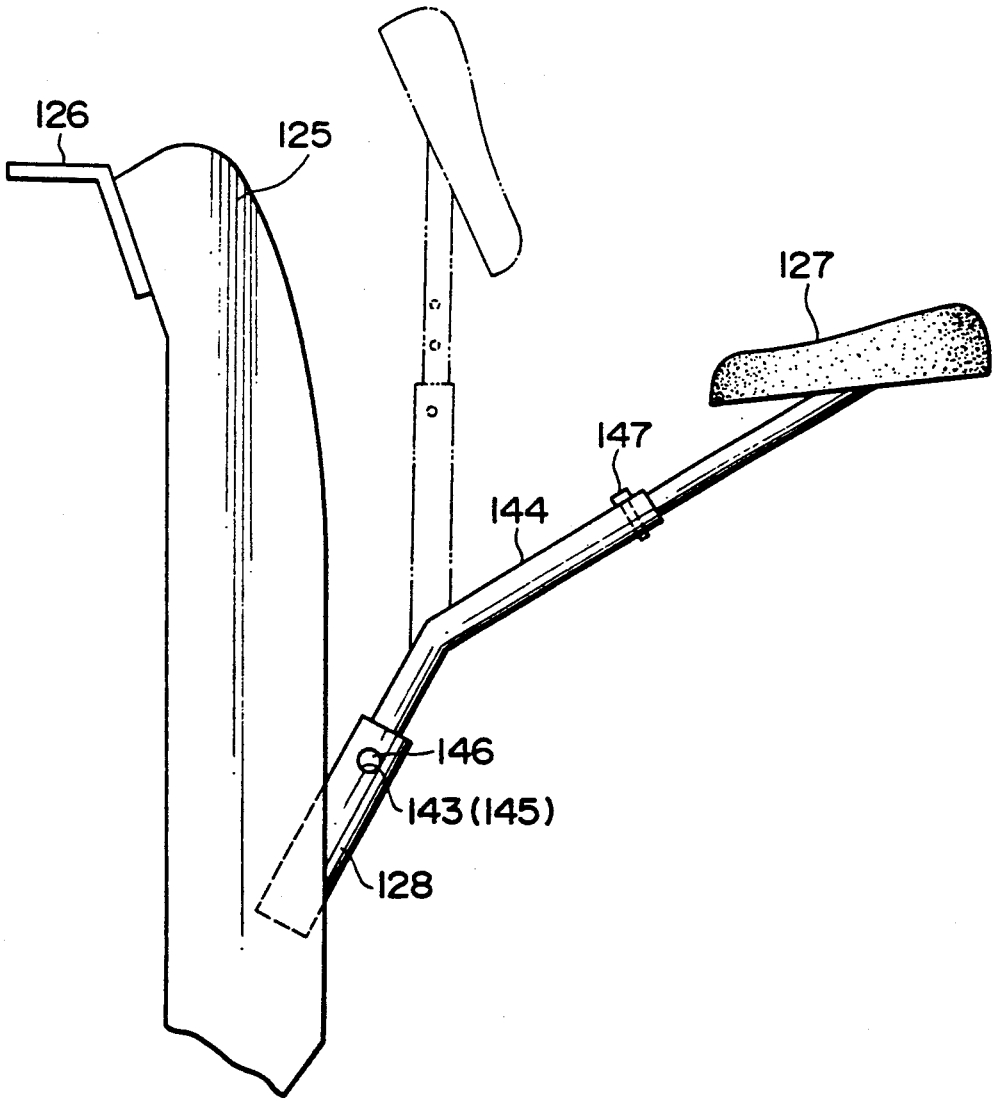
FIG. 10 is a side view of an essential part of a seat device.

Referring to FIG. 10 which shows a mounting structure of the seat 127, the mounting member 128 is obliquely fixed to a rear portion of the supporting member 125 as mentioned previously. The mounting member 128 is a pipe member formed with a pair of diametrical holes 143. A V-shaped hollow support post 144 is engaged at its lower end portion into the mounting member 128. The support post 144 is also formed with a pair of diametrical holes 145 to be aligned to the diametrical holes 143 of the mounting member 128. Under the engagement of the support post 144 with the mounting member 128, the diametrical holes 145 of the support post 144 are aligned to the diametrical holes 143 of the mounting member 128, and a pin 146 is inserted into the diametrical holes 143 and 145 to thereby lock the support post 144 to the mounting member 128. An upper portion of the support post 144 is telescopically slidable to a lower portion thereof, and an adjusting pin 147 is removably inserted through a connecting portion between the upper and lower portions of the support post 144. Accordingly, a height of the seat 127 can be suitably adjusted by drawing off the adjusting pin 147 and sliding the upper portion of the support post 144.

Figure 11:
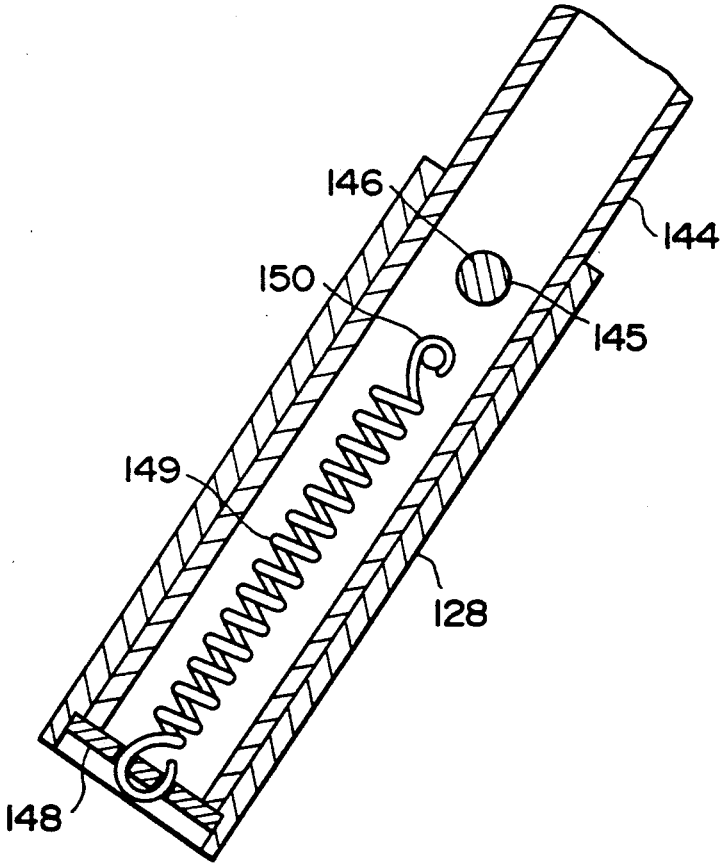
FIG. 11 is a vertical sectional view of a mounting member for a seat.

Referring to FIG. 11, a spring 149 is hooked under tension at its one end to a lower end of the mounting member 128, and is also hooked at the other end to a projection 150 formed in the support post 144. Accordingly, the support post 144 is mormally biased by the spring 149 so as to be always disposed in the mounting member 128. When the pin 146 is drawn to rotate the support post 144 at 180 degrees in the mounting member 128, and is then inserted into the holes 143 and 145 again, the seat 127 is so inverted as to stand substantially upright as shown by a phantom line in FIG. 10. In rotating the support post 144, there is no fear that the support post 144 will be disengaged from the mounting member 128 since the support post 144 is normally drawn by the spring 149. In this manner, when the seat 127 is not used, the support post 144 can be rotated to an upright position as mentioned above, thereby ensuring a wide working area behind the vehicle body.

Figure 7:
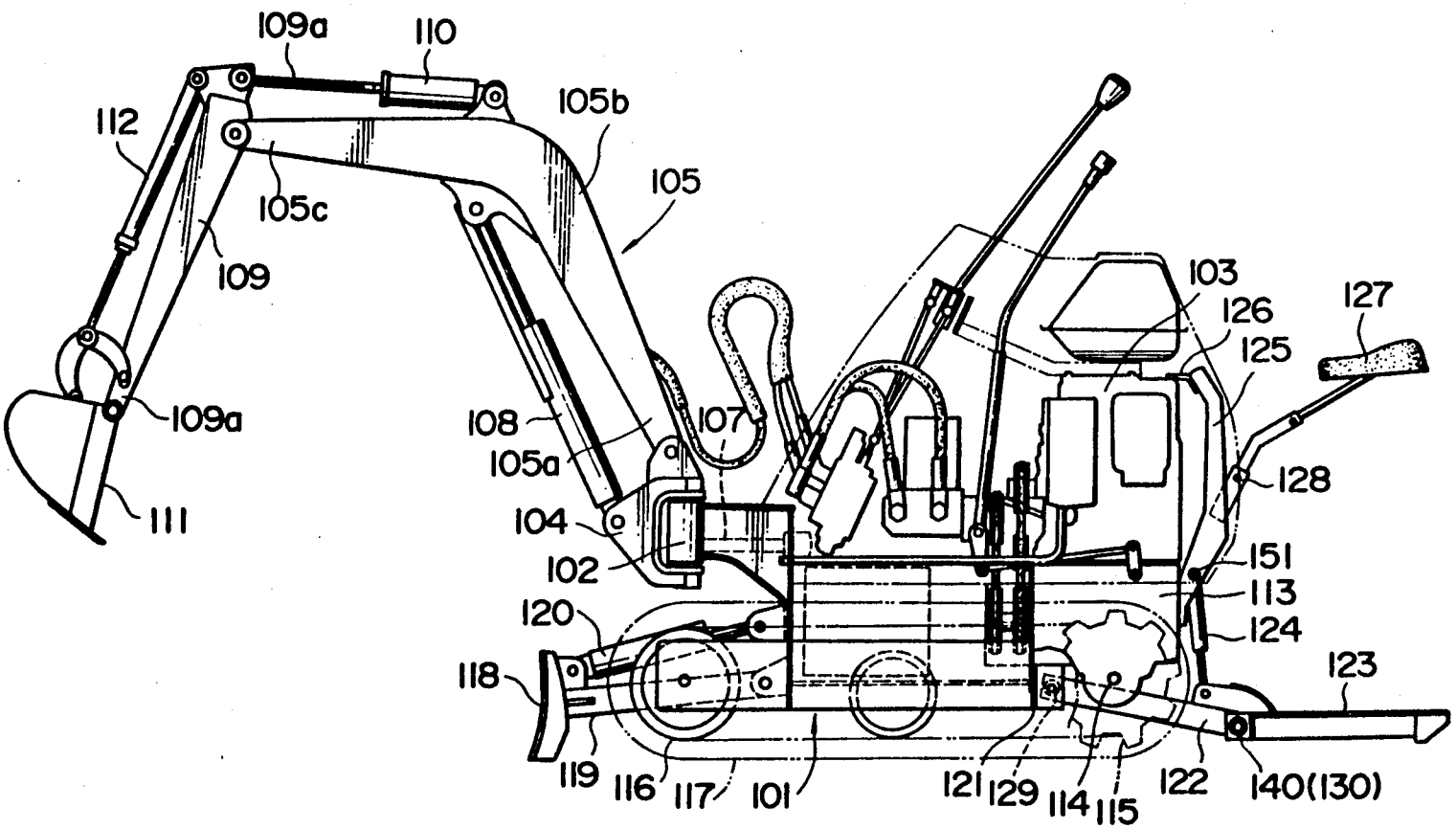
FIG. 7 is a partially cut-away side view of the miniature shovel car according to a second preferred embodiment of the present invention.

As shown in FIG. 7, the supporting member 125 is firmly fixed to both the bracket 126 on the engine 103 and the transmission case 113. Further, a supporting portion 151 of the hydraulic cylinder 124 for raising and lowering the step 123 and the mounting member 128 for mounting the seat 127 are firmly supported to the supporting member 125.

According to the second preferred embodiment of the present invention as mentioned above, the end of the step arm is pivotably supported at a position in front of the driving shafts, so that a weight of an operator on the step is loaded at the central portion of the vehicle body. Accordingly, although a vehicle weight is light, a ground load is increased by the addition of the operator weight, thereby obtaining an increased load greater than the vehicle weight as an excavating force. Thus, although the vehicle body of the miniature shovel car is light and compact, a sufficient excavating performance can be provided.

It should be understood that various modifications may be made without departing from the spirit of the present invention and that such modifications are intended to be embraced by the present invention.

What is claimed is:

1. In a miniature shovel car including a vehicle body, a working boom mounted to a front portion of said vehicle body, a boom cylinder for vertically pivotably operating said boom, a swing cylinder for horizontally pivotably operating said boom, and an engine and a transmission case both mounted on a rear portion of said vehicle body, said transmission case having a recess formed at a laterally central portion of a downwardly facing surface thereof and extending in a longitudinal direction of said transmission case, a step device comprising a step arm having a front end pivotably mounted to said transmission case at a front portion of said recess, and a step mounted to a rear end of said step arm, said step arm being mounted so as to be raised and lowered, wherein said step arm is retracted into said recess when raised.

2. The step device as defined in claim 1 further comprising a leveling blade detachably mounted to a rear end of said step.

3. The step device as claimed in claim 1 including driving shafts projecting laterally from said transmission case, wherein said step arm is mounted to said transmission case at a position in front of said driving shafts.

4. The device as claimed in claim 3 including means for raising and lowering said step arm.

* * * * *